US008019248B2

(12) United States Patent
Takahashi

(10) Patent No.: US 8,019,248 B2
(45) Date of Patent: Sep. 13, 2011

(54) SHEET CONVEYING APPARATUS, AND IMAGE FORMING APPARATUS

(75) Inventor: Hiroyuki Takahashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/695,302

(22) Filed: Jan. 28, 2010

(65) Prior Publication Data

US 2010/0196044 A1 Aug. 5, 2010

(30) Foreign Application Priority Data

Jan. 30, 2009 (JP) ..... 2009-020827

(51) Int. Cl.
*G03G 21/00* (2006.01)

(52) U.S. Cl. ..... 399/99; 399/124

(58) Field of Classification Search ..... 399/91, 399/98, 99, 107, 110, 121, 124, 125, 361, 399/388, 393, 397
See application file for complete search history.

(56) References Cited

U.S. PATENT DOCUMENTS 5,691,807 A * 11/1997 Fuei et al. ..... 399/130
2008/0075503 A1* 3/2008 Tanaka et al. ..... 399/124

FOREIGN PATENT DOCUMENTS

JP 2000-118760 4/2000

* cited by examiner

*Primary Examiner* — David P Porta
*Assistant Examiner* — Benjamin Schmitt
(74) *Attorney, Agent, or Firm* — Canon USA Inc IP Division

(57) ABSTRACT

An upper conveyance guide is provided at an apparatus main body. A guide surface of a lower conveyance guide is provided facing a guide surface of the upper conveyance guide, and can be drawn out in the direction intersecting the sheet conveyance direction with respect to the apparatus main body. A cleaning unit is provided on the backside in the drawing-out direction of the lower conveyance guide, moves together with the lower conveyance guide when the lower conveyance guide is drawn out from the apparatus main body, and cleans the guide surface of the upper conveyance guide.

11 Claims, 9 Drawing Sheets

SHEET CONVEYING APPARATUS, AND IMAGE FORMING APPARATUS

BACKGROUND OF THE INVENTION

1. Field of the Invention

The present invention relates to a sheet conveying apparatus having a conveyance guide, and to an image forming apparatus including the sheet conveying apparatus, e.g., a copying machine, a printer, a facsimile, or a multifunction peripheral of these apparatuses. More particularly, the present invention relates to cleaning of the conveyance guide which is equipped in the apparatus main body.

2. Description of the Related Art

A conventional electro-photographic image forming apparatus, such as a copying machine, a printer, a facsimile, or a multifunction peripheral of these apparatuses, includes a sheet conveying apparatus configured to convey a sheet, and an image forming unit configured to form a toner image on the sheet which has been conveyed by the sheet conveying apparatus. In general, the sheet conveying apparatus has a conveyance guide for guiding a sheet to be conveyed, and is configured to guide the sheet between the conveyance guides.

In recent years, a print on-demand (POD) market has required high productivity, increased function, and high durability for an image forming apparatus used in the POD market. Since the image forming apparatus deals with many media, the image forming apparatus may convey a sheet containing much paper dusts. Further, in such a highly durable image forming apparatus, a large number of sheets passes through the apparatus in one period of service maintenance. Therefore, in the image forming apparatus, the paper dusts coming from the sheets could accumulate on the conveyance guide in large quantity.

In such an image forming apparatus, since the paper dusts accumulates on the conveyance guide as use time increases, the accumulated paper dusts could generate conveyance faults of a sheet or image defects. Thus, in order to prevent these problems, the conveyance guide is configured to be a drawable conveyance unit, and an operator cleans the conveyance guide by drawing out the conveyance unit from an apparatus main body at a time of service maintenance.

Japanese Patent Application Laid-Open No. 2000-118760 discusses a technique by which a user can easily clean a part where paper dusts have a tendency to accumulate. In this technique, an apparatus main body includes a cleaning unit which is in contact with a conveyance guide serving as a sheet control member. By drawing out the conveyance guide in the direction intersecting the sheet conveyance direction, a user can clean paper dusts and dusts accumulating on the conveyance guide.

In recent years, positioning of an image leading edge and a sheet (leading edge registration) with higher accuracy has become necessary to improve an image quality. Thus, conveyance units on the upstream side of an image bearing member such as a photosensitive drum or an intermediate transfer belt, adopt following configuration in many cases. When a pair of upper and lower conveyance guides is configured to be drawn out to the outside as a unit, an attachment position deviates at a time of attaching and conveyance accuracy decreases. Thus, only a lower conveyance guide of the conveyance unit can be drawn out. In addition, according to this configuration of the conveyance unit, an operator can be prevented from accidentally touching and damaging the image bearing members such as a photosensitive drum and an intermediate transfer belt during a cleaning operation.

When only one of a pair of the conveyance guides is configured to be drawn out, an operator can easily draw out and clean the conveyance guide. However, an operator should put his or her hand into an apparatus main body and cleans the conveyance guide remaining in the apparatus main body. Thus, the operator can not fully clean the conveyance guide remaining in the apparatus main body. Therefore, an apparatus having good operability which can be more accurately cleaned is required.

SUMMARY OF THE INVENTION

The present invention is directed to a sheet conveying apparatus and a image forming apparatus which are capable of efficiently cleaning a conveyance guide provided in an apparatus main body.

According to an aspect of the present invention, a sheet conveying apparatus configured to convey a sheet along a sheet conveyance path provided in an apparatus main body includes a first conveyance guide, a second conveyance guide, and a cleaning unit. The first conveyance guide has a first guide surface for guiding a sheet. The second conveyance guide has a second guide surface arranged facing the first guide surface of the first conveyance guide. The second conveyance guide serves as the sheet conveyance path together with the first conveyance guide, and can be drawn out in a direction intersecting a sheet conveyance direction with respect to the apparatus main body. The cleaning unit is provided on a back side in the drawing-out direction of the second conveyance guide. The cleaning unit moves together with the second conveyance guide when the second conveyance guide is drawn out from the apparatus main body, and cleans the first guide surface of the first conveyance guide. The cleaning unit includes a cleaning member being in contact with the first guide surface of the first conveyance guide, and a pushing member to push the cleaning member toward the first guide surface side.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
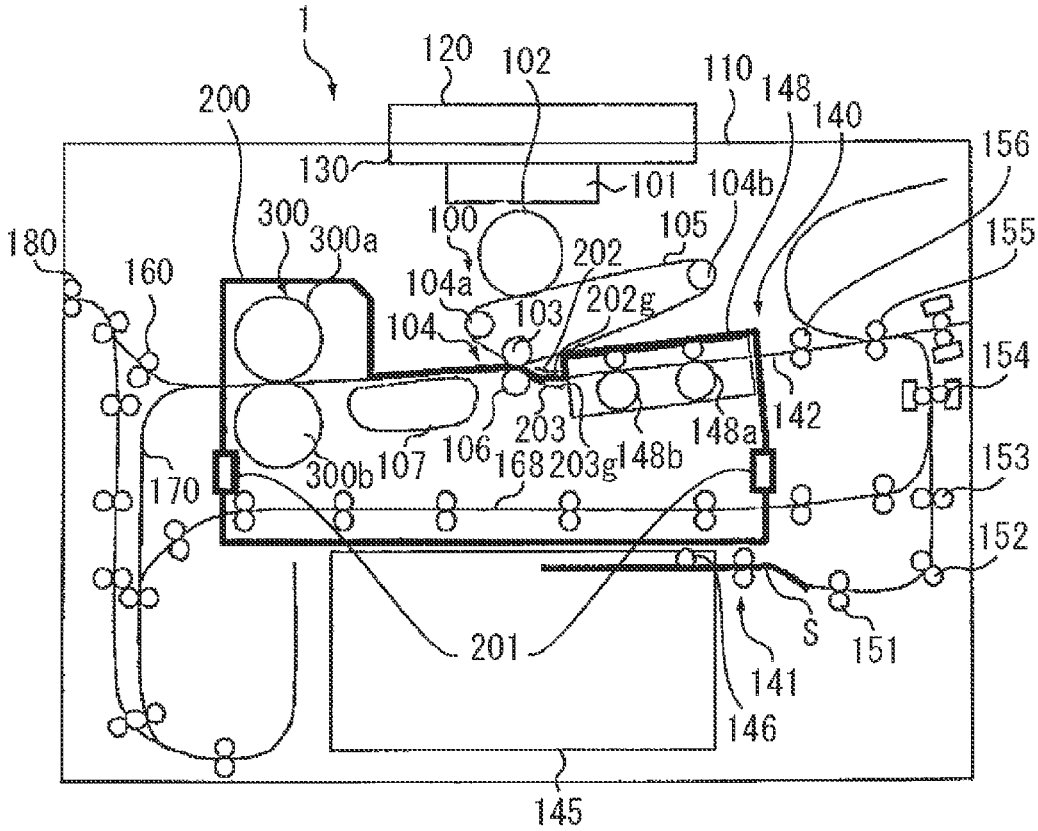
FIG. 1 schematically illustrates a printer as one example of an image forming apparatus according to the first exemplary embodiment of the present invention.

FIG. 1 schematically illustrates a printer as one example of an image forming apparatus according to the first exemplary embodiment of the present invention.

In FIG. 1, a printer 1 is an image forming apparatus, and a printer 110 is a main body of the image forming apparatus.

The printer 1 includes a document feeding apparatus 120 arranged on the upper side of the printer main body 110, and an image reading unit 130 which reads a document laid on an original stacking stand (not illustrated). Further, the printer 1 includes a sheet conveying apparatus 140 configured to convey a sheet S, an image forming unit 100 configured to forma toner image on the sheet S conveyed by the sheet conveying apparatus 140, and a fixing unit 300 configured to fix the toner image formed by the image forming unit 100 on the sheet S.

The sheet conveying apparatus 140 includes a sheet feeding unit 141 configured to feed the sheet S, a sheet conveyance path 142 for conveying the sheet S, and a skew correction mechanism 148 which is a skew correction unit configured to perform skew correction or timing correction of the sheet S. The sheet conveying apparatus 140 includes a plurality of conveyance roller pairs 151 to 156 provided at the sheet conveyance path 142. The sheet conveying apparatus 140 includes a discharge roller pair 180 provided at a path 160 of the sheet conveyance path 142. The discharge roller pair 180 discharges the sheet S carrying the image fixed by the fixing unit 300, from the printer main body 110. The sheet conveying apparatus 140 conveys a sheet along the sheet conveyance path 142 by these conveyance roller pairs (conveyance means).

The skew correction mechanism 148 is an active registration type for correcting skew of the sheet S while conveying the sheet S. The skew correction mechanism 148 includes two skew correction roller pairs 148*a* and 148*a* arranged at each side in the width direction intersecting the sheet conveyance direction, and includes two shift roller pairs 148*b* and 148*b* arranged at each side in the width direction. FIG. 1 illustrates only each one of these roller pairs and shift roller pairs. The skew correction roller pairs 148*a* and 148*a* are independently driven and rotated, and can rotate at different conveying speeds from each other. The shift roller pairs 148*b* and 148*b* can slide in width direction. The conveying speed of the skew correction roller pairs 148*a* and 148*a* is set according to a skew amount of the sheet S. Accordingly, the skew of the sheet S is corrected while it is conveyed by each of the skew correction roller pairs 148*a* and 148*a*. Further, the position of the sheet S is corrected in the width direction by the shift roller pairs 148*b* and 148*b*.

The image forming unit 100 is arranged on the downstream side in the sheet conveyance direction of the skew correction mechanism 148. The image forming unit 100 includes a photosensitive drum 102, a transfer unit 104 configured to transfer a toner image on the sheet S, and an exposure unit 101, and further includes a charging device and a development device which are not illustrated.

The transfer unit 104 includes an intermediate transfer belt 105 stretched, conveyed, and driven by rollers such as a drive roller 104*a*, a tension roller 104*b*, and a transfer counter roller 103. Further, the transfer unit 104 includes a transfer roller 106 pressure-contacting the intermediate transfer belt 105 pressured by the transfer counter roller 103. A transfer nip portion is formed by pressure-contacting the transfer roller 106 with the intermediate transfer belt 105.

The sheet feeding unit 141 includes a cassette 145 which is a sheet accommodating unit for accommodating a plurality of the sheets S, and a pickup roller 146 for feeding the sheets S accommodated in the cassette 145. The cassette 145 can selectively accommodate various kinds of the sheets S.

In the printer 1 having the aforementioned configuration, when a control device (not illustrated) provided at the printer main body 110 outputs an image reading signal to the image reading unit 130, the image reading unit 130 reads an image.

Then, the charging device (not illustrated) uniformly charges the surface of the photosensitive drum 102. Next, the exposure unit 101 forms a latent image on the surface of the photosensitive drum 102 by exposing it with light. Then, the development device performs toner development on the electrostatic latent image formed on the photosensitive drum 102 and forms a toner image on the photosensitive drum 102. The toner image is transferred onto the intermediate transfer belt 105.

A cleaner (not illustrated) for cleaning a toner and paper dusts contacts the surface of the intermediate transfer belt 105 and the surface of the photosensitive drum 102 to clean each surface.

When the control device (not illustrated) outputs a paper feed signal to the sheet feeding unit 141, the pickup roller 146 feeds the sheet S one by one from the cassette 145 in which sheets S having a designated size are accommodated. The conveyance roller pairs 151 to 156 convey the fed sheets S to the skew correction mechanism 148, and the skew correction mechanism 148 corrects the skew.

After correcting the skew, the sheet S is conveyed to the transfer nip portion formed by the intermediate transfer belt 105 and the transfer roller 106.

The sheet S onto which the intermediate transfer belt 105 and the transfer roller 106 transfer the toner image is conveyed to the fixing unit 300 by a conveyance belt 107. In the fixing unit 300, rollers 300*a* and 300*b* which face each other heats and presses the sheet S, and fuses and fixes a toner on the sheet S.

The sheet S on which the image is fixed passes the path 160, and discharged to a sheet post-processing apparatus (not illustrated) by the discharge roller pair 180.

In addition, when an image is formed on two-sides of the sheet S, the sheet S is conveyed to a reversing path 170 by switching of a changeover member (not illustrated). When the sheet S is conveyed to the reversing path 170, the sheet s exchanges the front end and the back end by performing a switch-back operation, and is conveyed to a re-conveyance path 168.

Then, the sheet S enters the upstream side of the conveyance roller pair 154 while coinciding the timing of the sheet S with the timing of a sheet S of a succeeding job conveyed from the sheet feeding unit 141, and is fed to the image forming unit 100 through the conveyance rollers 154 to 156 and the skew correction mechanism 148. Since the image forming process of the sheet surface this time is similar to that in the first surface of the sheet, the description is omitted.

A pair of conveyance guides 202 and 203 which configure a part of the sheet conveyance path 142 is provided on the upstream side in the sheet conveyance direction of the image forming unit 100 and between the skew correction mechanism 148 and the transfer roller 106 (a transfer nip portion) of the image forming unit 100. The conveyance guide 202 (which will be hereinafter referred to as an upper conveyance guide) which is a first conveyance guide is provided fixed on the printer main body 110. The upper conveyance guide 202 has a guide surface 202*g* which is a first guide surface.

The conveyance guide 203 (which will be referred to as a lower conveyance guide) which is a second conveyance guide has a guide surface 203*g* which is a second guide surface. The guide surface 203*g* is arranged facing the guide surface 202*g* of the upper conveyance guide 202. The lower conveyance guide 203 is arranged on the lower side of the upper conveyance guide 202 and guides a sheet with the guide surface 202*g* of the lower surface of the upper conveyance guide 202 and the guide surface 203*g* of the upper surface of the lower conveyance guide 203.

In the first exemplary embodiment, a conveyance unit 200 is configured by integrating the skew correction mechanism 148, the lower conveyance guide 203, the transfer roller 106, the conveyance belt 107, the fixing unit 300, the re-conveyance path 168, and the conveyance roller pairs provided at the re-conveyance path 168. The conveyance unit 200 is supported by a pair of rail mechanisms 201 and 201 and can be drawn out in the direction intersecting the sheet conveyance direction with respect to the printer main body 110.

The pair of rail mechanisms 201 and 201 is provided horizontally. The lower conveyance guide 203 is approximate-horizontally drawn out from the printer main body 110 while the guide surface 202*g* of the upper conveyance guide 202 is approximately parallel with the guide surface 203*g* of the lower conveyance guide 203.

Figure 2:
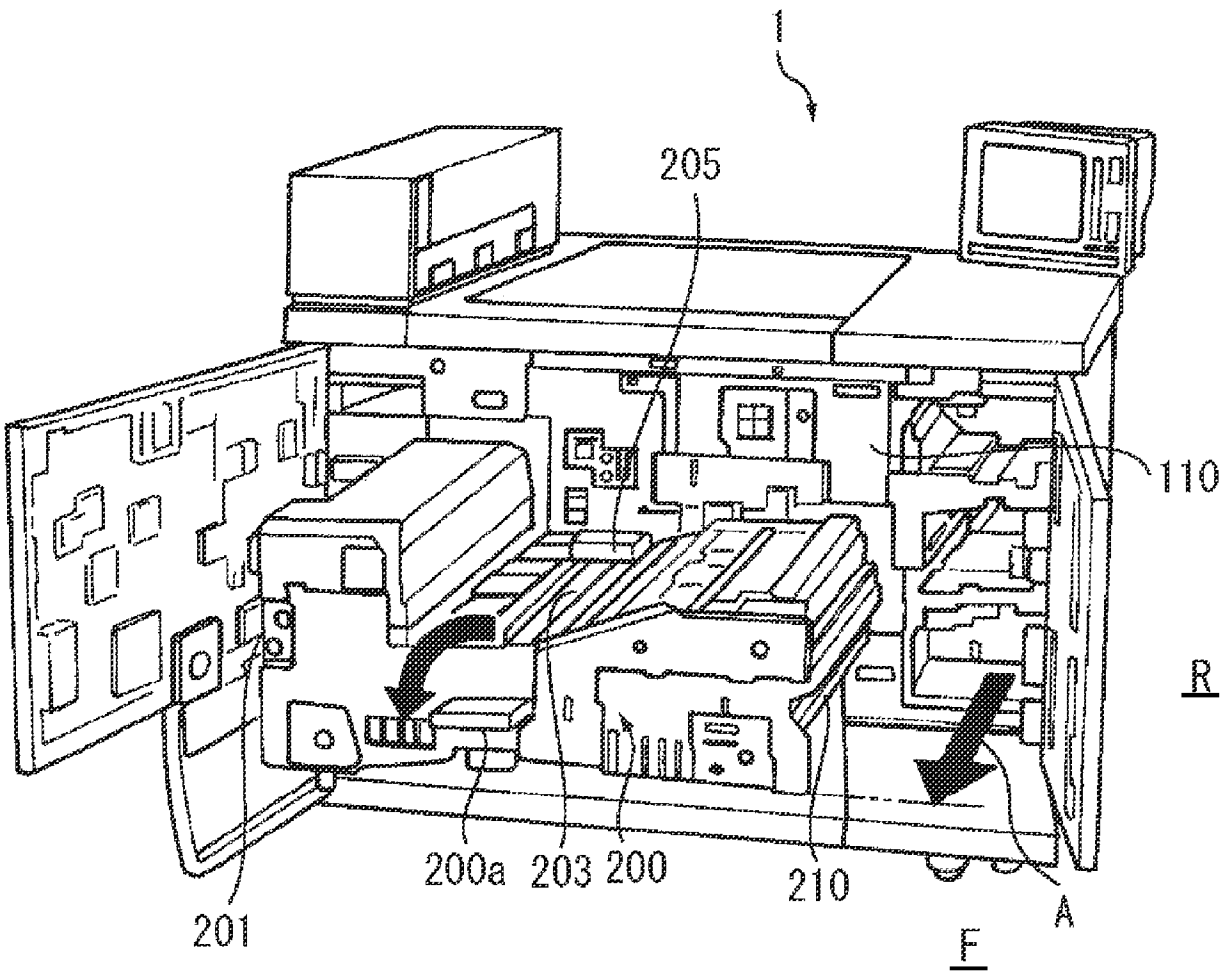
FIG. 2 is a perspective view for schematically illustrating a state that a conveyance unit of a printer is drawn out from a printer main body.

FIG. 2 is a perspective view for schematically illustrating the conveyance unit 200 of the printer 1 drawn out from the printer main body 110.

The conveyance unit 200 has an operation lever 200*a* which can lock or cancel the locking with respect to the printer main body 110. An operator operates the operation lever 200*a* to cancel the locking by rotating, and the conveyance unit 200 can be drawn out in the direction (the direction illustrated with an arrow A in FIG. 2) intersecting the sheet conveyance direction along the rail mechanism 201. The conveyance unit 200 is drawn out by sliding toward the front side of the printer main body 110 (toward the position F side in FIG. 2).

Further, the drawn conveyance unit 200 slides in the direction opposite to the arrow A direction, and is attached to the back side of the printer main body 110 (the position R side in FIG. 2). In addition, a stopper (not illustrated) is provided to prevent the conveyance unit 200 from coming off and falling from the rail mechanism 201 when the conveyance unit 200 is drawn out.

The lower conveyance guide 203 is arranged on the upper surface of a main body of the conveyance unit 200, and is exposed to an external when the conveyance unit 200 is drawn out from the printer main body 110. When the conveyance unit 200 is drawn out, the lower conveyance guide 203 is drawn out in the arrow A direction from the printer main body 110. However, the upper conveyance guide 202 (FIG. 1) is not drawn out since the upper conveyance guide 202 is fixed to the printer main body 110. The upper conveyance guide 202 and the lower conveyance guide 203 are formed longer than the length of a paper passing area in the width direction intersecting with the sheet conveyance direction. The paper passing area has a maximum size of a sheet to be conveyed, and covers a deviation range of the sheet in the width direction (horizontal registration).

Here, the paper dusts adhere to the upper conveyance 202 (FIG. 1) when a sheet to be conveyed is rubbed.

A cleaning unit 205 configured to clean the upper conveyance guide 202 is provided at a position on the back side (the position R side in FIG. 2) in the drawing-out direction of the lower conveyance guide 203. The cleaning unit 205 is arranged outside the paper passing area.

The cleaning unit 205 is fixed on the lower conveyance guide 203, and moves together with the lower conveyance guide 203 when the lower conveyance guide 203 is drawn out from the printer main body 110. Accordingly, the cleaning unit 205 cleans a approximately entire area in the width direction intersecting with the sheet conveyance direction of the upper conveyance guide 202. Therefore, the upper conveyance guide 202 can be efficiently cleaned by the cleaning unit 205.

Figure 3:
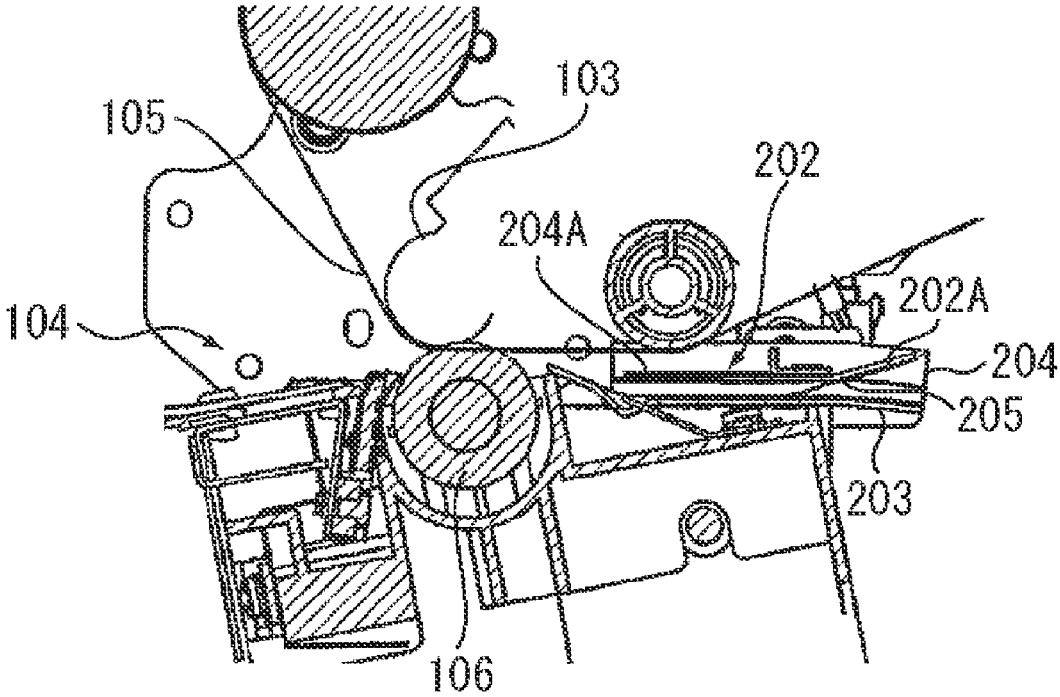
FIG. 3 is an enlarged view for illustrating a transfer unit and its neighborhood illustrated in FIG. 1.

A configuration of the upper conveyance guide 202 which is an object to be cleaned will be described in detail below. FIG. 3 is an enlarged view of the transfer unit 104 illustrated in FIG. 1 and its neighborhood.

The upper conveyance guide 202 includes a guide base body 202A, and two sheet control members 204 and 204A fixed to the guide base body 202A. The guide base body 202A is made of a metal or a hard material such as a hard resin, and is fixed to the printer main body 110. The guide base body 202A and the sheet control members 204 and 204A are formed such that an entire length in the width direction is longer than the length in the width direction of the paper passing area.

The sheet control members 204 and 204A are formed in a thin sheet state, and is made of a flexible material (e.g., a resin). The sheet control members 204 and 204A extend on the downstream side in the sheet conveyance direction, and is projecting toward a conveyance space to which a sheet is conveyed from the guide base body 202A. When the sheet is conveyed, the sheet control members 204 and 204A contact the surface (the upper surface) of the sheet, and control an orientation of the sheet. Accordingly, the skew and the position of a leading edge of the sheet in the width direction are corrected by the skew correction mechanism 148, and the sheet is well guided to the transfer unit 104 of the image forming unit 100, and a positional deviation of an image formed on the sheet decreases. Thus, the positional accuracy of an image formed on the sheet is improved.

The sheet control members 204 and 204A have flexibility. When the sheet is thin, the sheet control members 204 and 204A hardly bend and is in a state as illustrated in FIG. 3. However, when the sheet is thick, the sheet control members 204 and 204A bend due to rigidity of the sheet, so that the conveyance resistance of the sheet decreases.

The sheet control member 204 is arranged to be in contact with the guide surface 203*g* of the lower conveyance guide 203 arranged downward, and is always in slidable contact with the surface (the upper surface) of the sheet conveyed. Therefore, paper dusts easily adhere to the guide surface of the sheet control member 204. Further, the paper dusts adhering to the sheet control member 204 easily scatter to the guide surface of the guide base body 202A and the guide surface of the sheet control member 204A. In addition, the guide surface of the guide base body 202A, the guide surface of the sheet control member 204, and the guide surface of the sheet control member 204A are facing the guide surface 203*g* of the lower conveyance guide 203, and constitute the guide surface 202*g* of the upper conveyance guide 202.

In the first exemplary embodiment, the cleaning unit 205 is arranged on the back side in the direction parallel with the drawing-out direction, on the lower conveyance guide 203.

Thus, together with a drawing-out operation of the conveyance unit 200 (the lower conveyance guide 203), the cleaning unit 205 cleans the guide surfaces of the sheet control members 204 and 204A, and the guide base body 202A.

Figure 4:
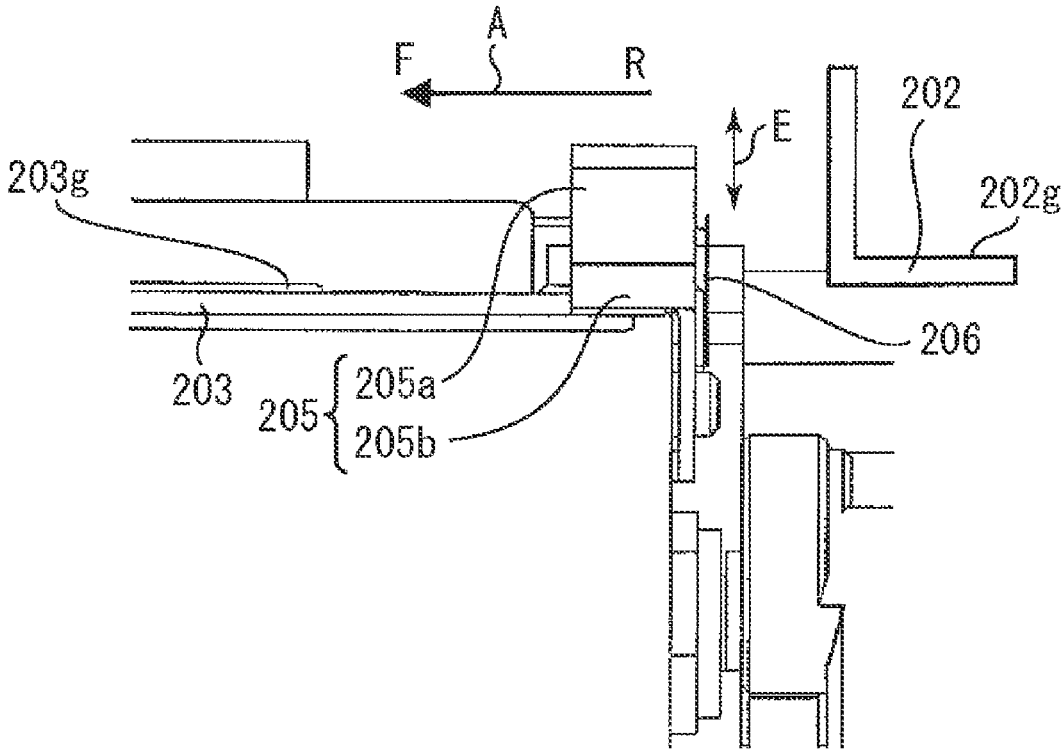
FIG. 4 is a side view for illustrating a cleaning unit in a state of drawing out a conveyance unit from a printer main body.

FIG. 4 is a side view for illustrating the cleaning unit 205 when the conveyance unit 200 is drawn out from the printer main body 110.

The cleaning unit 205 includes a cleaning member 205*a* in contact with the guide surface 202*g* of the upper conveyance guide 202, and an elastic member 205*b* as a pushing member for pushing the cleaning member 205*a* toward the first guide surface of the upper conveyance guide 202. The cleaning member 205*a* is elastic and deformable, and formed by bundling elastically deformable wire-shaped members made of a synthetic resin, and is configured to absorb foreign matters such as paper dusts.

The cleaning member 205*a* includes an elastic member 205*b* fixed on the back surface with an adhesive. The elastic member 205*b* is made of a foamable material, which is extensible and contractible in the arrow E direction vertical to the guide surface 202*g* of the upper conveyance guide 202. Accordingly, since the cleaning unit 205 can be produced by an easy operation of attaching the elastic member 205*b* made of a foamable material to the cleaning member 205*a*, manufacturing cost can be reduced.

Further, when the lower conveyance guide 203 is attached to the printer main body 110, the elastic member 205*b* is deformed under pressure, and restoration force (urging force) of the compressed and deformed elastic material 205*b* presses the cleaning member 205*a* to the guide surface 202*g* of the upper conveyance guide 202. By forming a double-layer of the cleaning member 205*a* and the elastic member 205*b*, the elastic member 205*b* causes the cleaning member 205*a* to accurately contact the guide surface 202*g* of the upper conveyance guide 202, and a favourable cleaning ability free from cleaning failure can be obtained.

When the lower conveyance guide 203 is drawn out from the printer main body 110, the cleaning unit 205 is not in contact with the upper conveyance guide 202 as illustrated in FIG. 4, so that the compressed elastic member 205*b* returns to its original state. The elastic member 205*b* in a non-compressed state (an unloaded state) is formed projecting above the guide surface 202*g* of the upper conveyance guide 202. Further, when the lower conveyance guide 203 is attached to the printer main body 110, a protection sheet 206 which is a flexible member for protecting the side surface of the elastic member 205*b* is facing the side surface of the lower conveyance guide 203 on the back side in the drawing-out direction in the elastic member 205*b*.

FIG. 5 illustrates the cleaning unit 205 cleaning the guide surface 202*g* of the upper conveyance guide 202, together with the drawing-out operation and attaching operation of the lower conveyance guide 203. FIG. 5A illustrates a state in the middle of drawing-out the lower conveyance guide 203. FIG. 5B illustrates a state that the lower conveyance guide 203 is in the middle of drawing-out and a part of the cleaning unit 205 is separated from the upper conveyance guide 202. FIG. 5C illustrates a state that the lower conveyance guide 203 is drawn out. FIG. 5D illustrates a part of the cleaning unit 205 pressured to contact with the upper conveyance guide 202 when the lower conveyance guide 203 is attached. FIG. 5E illustrates the lower conveyance guide 203 in the middle of attaching.

Figure 5A:
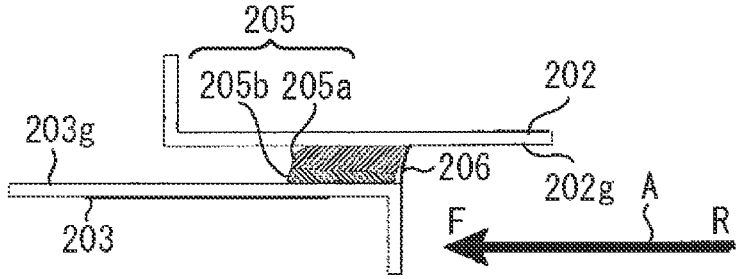
FIGS. 5A, 5B, 5C, 5D, and 5E illustrate a cleaning unit cleaning a guide surface of an upper conveyance guide in conjunction with a drawing-out operation and an attaching operation for a lower conveyance guide.
Figure 5B:
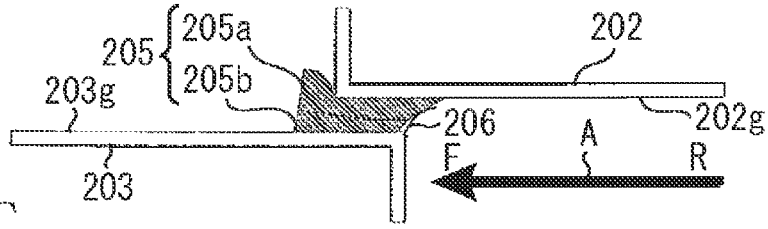

The elastic member 205*b* is deformed by pressure to make the cleaning member 205*a* contact the guide surface 202*g* of the upper conveyance guide 202 under pressure. In this state, as illustrated in FIGS. 5A and 5B, when the lower conveyance guide 203 is drawn out in the drawing-out direction illustrated with the arrow A, the cleaning unit 205 removes paper dusts adhering to the guide surface 202*g* of the upper conveyance guide 202.

Accordingly, by arranging the cleaning unit 205 on the back side in the drawing-out direction of the lower conveyance guide 203 indicated by the arrow A, it becomes possible to clean the approximately entire guide surface 202*g* in the width direction of the upper conveyance guide 202, together with the drawing-out operation of the conveyance unit 200.

Particularly, since the sheet control member 204 (FIG. 3) of the upper conveyance guide 202 certainly contacts the a conveyed sheet, paper dusts easily accumulate on the leading edge or the guide surface of the sheet control member 204.

In the first exemplary embodiment, since the sheet control member 204 is cleaned by the cleaning unit 205, paper dusts can be prevented from falling onto a sheet due to vibration induced by momentary bend of the sheet control member 204.

It is necessary to clean at least the sheet control member 204. However, in the first exemplary embodiment, the length in the sheet conveyance direction of the cleaning unit 205 is set such that not only the sheet control member 204 but also the sheet control member 204A and the guide base body 202A can be cleaned. In other words, since the entire length in the sheet conveyance direction of the cleaning unit 205 is set to be longer than the entire length in the sheet conveyance direction including the guide base body 202A and the sheet control members 204 and 204A, the cleaning unit 205 can sufficiently clean the guide surface 202*g* of the upper conveyance guide 202 without cleaning failure. Accordingly, paper dusts can be more efficiently prevented from falling onto the sheet.

Therefore, image defects such as white spots can be prevented. The white spots occur in an image on a sheet because a toner image is not transferred onto a portion on which paper dusts fall. Particularly, in the first exemplary embodiment, the image is formed on the upper surface of a sheet, so that image defects can be reduced more effectively by cleaning the upper conveyance unit 202 facing the upper surface of the sheet.

Even if periodical service maintenance is not performed for a user, the user can unintentionally clean the upper conveyance guide 202 when the user draws out the conveyance unit 200, for example, to carry out a jamming treatment when a sheet is jammed. The unintentional cleaning by a user is particularly effective for a high durable image forming apparatus in which a large number of sheets passes until time of service maintenance.

Since the cleaning unit 205 cleans the upper conveyance guide 202, cleaning effects without individual variations can be stably acquired. Further, since an operator does not need to put his or her hands into the printer main body 110 to perform a cleaning operation, the operator does not damage the intermediate transfer belt 105. Further, the operator does not access the inside of the printer main body 110 to clean the upper conveyance guide 202, and can thus efficiently clean the upper conveyance guide 202 with the cleaning unit 205.

Figure 5C:
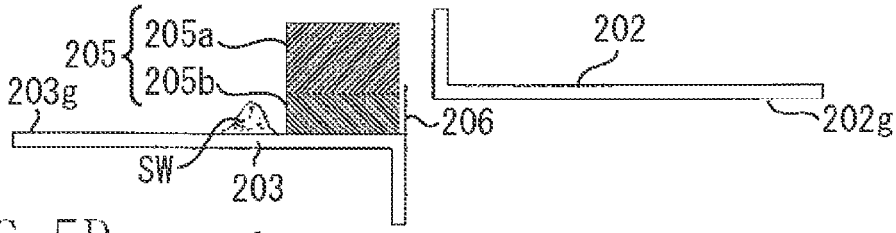

When the lower conveyance guide 203 is drawn out from the printer main body 110 as illustrated in FIG. 5C, paper dusts SW scraped out by the cleaning unit 205 accumulates on the lower conveyance guide 203. However, since the lower conveyance guide 203 is drawn out externally from the printer main body 110, an operator such as a user or a serviceman can easily clean the lower conveyance guide 203 when it is necessary. Further, as the accumulating paper dusts SW are outside of a conveyance area, the paper dusts SW can be prevented from adhering to a sheet conveyed.

Figure 5D:
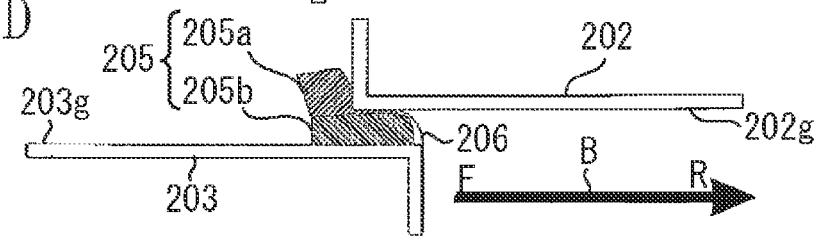

As illustrated in FIG. 5D, when the lower conveyance guide 203 moves in the attaching direction illustrated with the arrow B in the printer main body 110 direction, the protection sheet 206 comes to be in contact with an end of the upper conveyance guide 202. Thus, the end of the upper conveyance guide 202 does not hit the side of the elastic member 205*b*. Therefore, since the protection sheet 206 protects the elastic member 205*b*, the elastic member 205*b* can be prevented from damage. Then, the protection sheet 206 is pressed by the end of the upper conveyance guide 202 and bends while protecting the elastic member 205*b*. A part of the elastic member 205*b* is compressed and deformed by pressing of the end of the upper conveyance guide 202 through the protection sheet 206. The cleaning member 205*a* deforms while bending the bristles, and pressure-contacts the upper conveyance guide 202.

The protection sheet 206 protects the elastic member 205*b* even when the upper conveyance guide 202 on the printer main body side is detached at a time of service maintenance. Thus, even when the upper conveyance guide 202 comes to be in contact with the elastic member 205*b*, the elastic member 205 can be prevented from damage.

The lower conveyance guide 203 may be detached from a main body of the conveyance unit 200 at a time of service maintenance. When the lower conveyance guide 203 is attached to the main body of the conveyance unit 200 again, the lower conveyance guide 203 may be attached by mistake running on other members. In this state, if the protection sheet 206 is not provided, the elastic member 205*b* could come to be in contact with the other members not illustrated when the conveyance unit 200 is attached to the printer main body 110. By contrast, in the first exemplary embodiment, since the protection sheet 206 protects the elastic member 205*b*, the elastic member 205*b* can be prevented from contacting the other members and from damage.

Figure 5E:
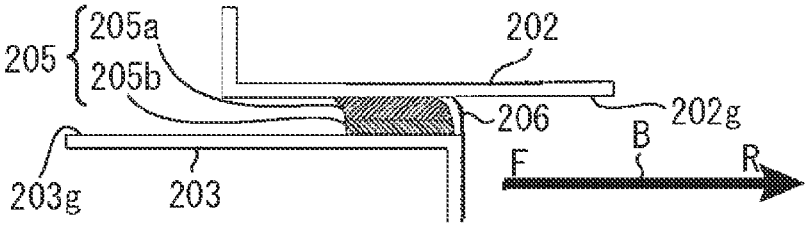

As illustrated in FIG. 5E, when the lower conveyance guide 203 is in the middle of attaching to the printer main body 110, the entire elastic member 205*b* is compressed and deformed, and the cleaning member 205*a* comes to be in slidable contact with the upper conveyance guide 202.

The conveyance unit 200 (illustrated in FIGS. 1 and 2) is a heavy weight substance. Thus, as the conveyance unit 200 is drawn out in the drawing-out direction along the rail mechanism 201, the rail mechanism 201 bends by the heavy weight of the conveyance unit 200, and the conveyance unit 200 goes downward in the gravity direction (lower direction). In the other words, even when an operator tries to draw the conveyance unit 200 horizontally in the direction intersecting the sheet conveyance direction from the printer main body 110, the conveyance unit 200 declines in the gravity direction, and a gap between a pair of the conveyance guides 202 and 203 changes.

Figure 6A:
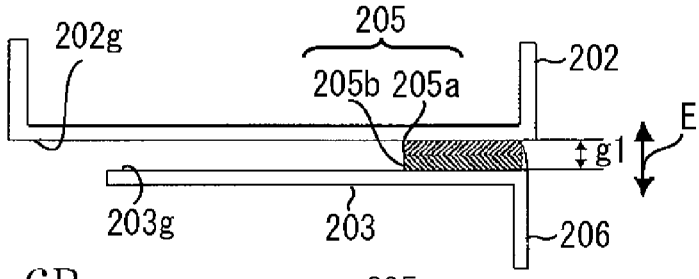
FIGS. 6A, 6B, and 6C illustrate how a gap between a pair of conveyance guides changes by the drawing-out operation of the conveyance unit.
Figure 6B:
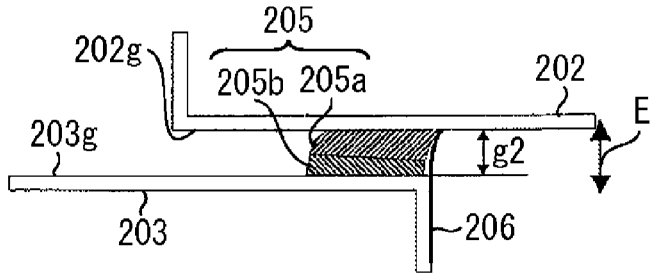
Figure 6C:
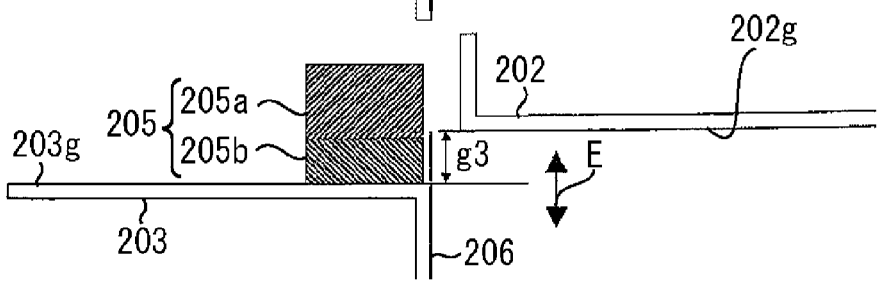

FIG. 6 illustrates pairs of gaps g1, g2, and g3 between the conveyance guides 202 and 203, which change according to operations for drawing out the conveyance unit 200. FIG. 6A illustrates the conveyance unit 200 attached to the printer main body 110. FIG. 6B illustrates the conveyance unit 200 in the middle of drawing out from the printer main body 110. FIG. 6C illustrates the conveyance unit 200 drawn out from the printer main body 110.

As illustrated in FIG. 6A, when the conveyance unit 200 is attached to the printer main body 110, since the weight of the conveyance unit 200 is uniformly applied on the rail mechanism 201, the bending amount of the rail mechanism 201 is the minimum, and the gap g1 between guides is the minimum.

On the other hand, as illustrated in FIG. 6C, when the conveyance unit 200 is drawn out from the printer main body 110, the weight of the conveyance unit 200 is applied concentrating on the end of the rail mechanism 201. Thus, the bending amount of the rail mechanism 201 is the maximum, and the gap g3 between guides is the maximum.

As illustrated in FIG. 6B, when the conveyance unit 200 is in the middle of drawing out from the printer main body 100, the bending amount of the rail mechanism 201 is a middle value between the maximum and minimum, and the gap 2 between guides is also the middle value between the maximum and minimum. In other words, the relation of the gap g1, the gap g2, and gap g3 is g1<g2<g3.

In the first exemplary embodiment, the cleaning unit 205 can expand and contract in the arrow E direction which is vertical to the guide surface 202*g* of the upper conveyance guide 202. A height of the cleaning unit 205 at the maximum compression is set to be smaller than the gap g1 between guides, and the height of the cleaning unit 205 in an unloaded state is set to be bigger than the gap g3 between guides.

As a result, even when the rail mechanism 201 bends by the weight of the conveyance unit 200 and the gap between the pair of the conveyance guides 202 and 203 is changed, the cleaning unit 205 is constantly in contact with the guide surface 202*g* of the upper conveyance guide 202 when the cleaning unit 205 faces the guide surface 202*g* of the upper conveyance guide 202. Therefore, the cleaning unit 205 can clean the guide surface 202*g* of the upper conveyance guide 202 in the entire width direction.

Figure 7:
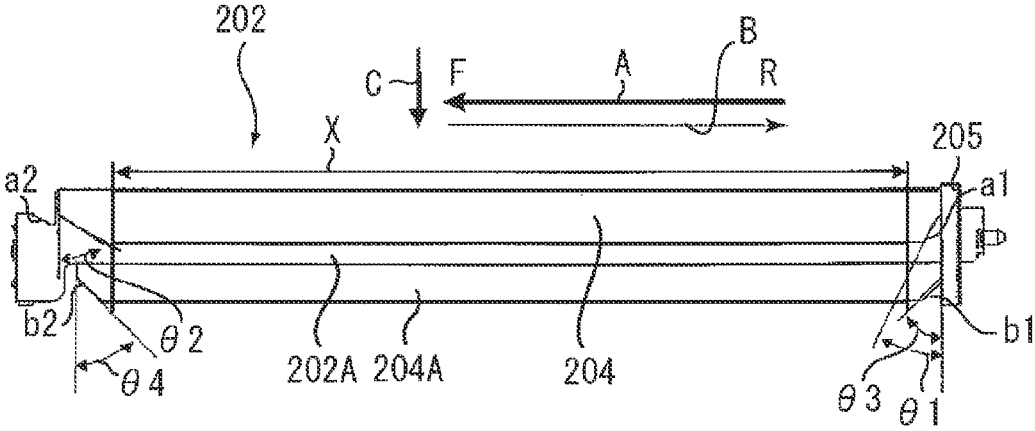
FIG. 7 is a bottom view for illustrating an upper conveyance guide and a cleaning unit facing the upper conveyance guide.

FIG. 7 is bottom view for illustrating the upper conveyance guide 202 and a cleaning unit 205 facing the upper conveyance guide 202.

As illustrated in FIG. 7, the cleaning unit 205 is provided outside of a paper passing area X in the upper conveyance guide 202. By arranging the cleaning unit 205 in this way, it becomes possible to clean an entire area where the paper dust can adhere to the sheet, so that cleaning can be efficiently carried out while saving a space. The arrow C in FIG. 7 indicates a sheet conveyance direction.

Here, one end a1 and b1 of the sheet control members 204 and 204A (ends on the back side) in the direction intersecting the sheet conveyance direction, come to be in contact with the cleaning unit 205 when the lower conveyance guide 203 is drawn out from the printer main body 110. Another ends a2 and b2 of the sheet control members 204 and 204A (ends on the front side) in the direction intersecting the sheet conveyance direction, come to be in contact with the cleaning unit 205 when the lower conveyance guide 203 is attached to the printer main body 110.

Therefore, both ends a1 and a2 of the sheet control member 204, and ends of the ends b1 and b2 of the sheet control member 204A, which are in contact with the cleaning unit 205, are formed inclining with respect to the sheet conveyance direction illustrated with the arrow C in FIG. 7.

Herewith, even when the side of the cleaning unit 205 comes to be in contact with the ends a1 and b1 of the sheet control members 204 and 204A at a time of drawing out the conveyance unit 200 from the printer main body 110, the ends a1 and b1 of the sheet control members 204 and 204A can be prevented from damage. In addition, even when the side of the cleaning unit 205 comes to be in contact with the ends a2 and b2 of the sheet control members 204 and 204A at a time of attaching the conveyance unit 200 to the printer main body 110, the ends a2 and b2 of the sheet control members 204 and 204A can be prevented from damage.

It is preferable that angles θ1, θ2, θ3, and θ4 of each of the ends a1, a2, b1, and b2 are inclined by 20° to 60° with respect to the sheet conveyance direction. Herewith, the ends a1, a2, b1, and b2 can be effectively prevented from damage, and a life of the sheet control members 204 and 204A can be prolonged.

Figure 8:
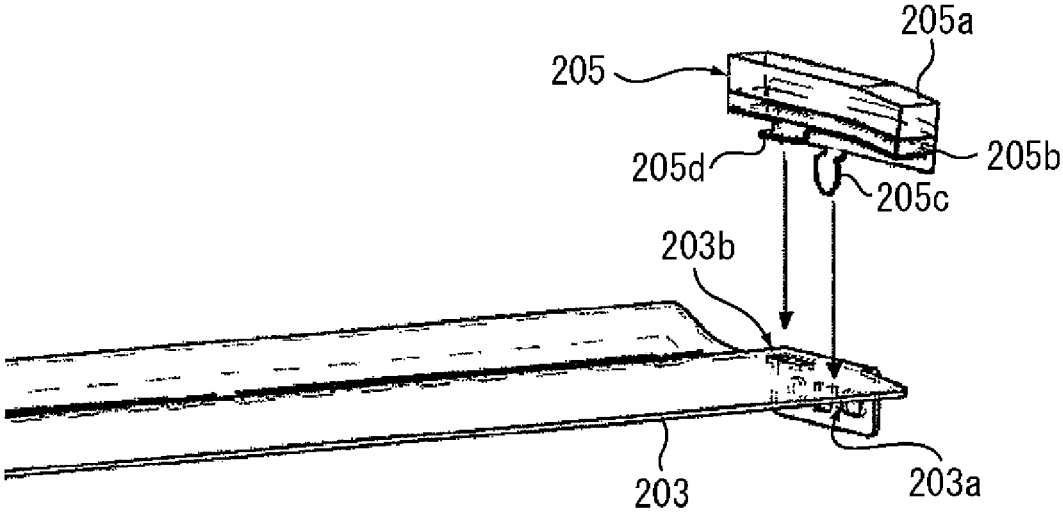
FIG. 8 illustrates an attachment structure of a cleaning unit.

FIG. 8 illustrates an attachment structure of the cleaning unit 205.

The cleaning unit 205 is provided detachably at the lower conveyance guide 203. More specifically, the lower conveyance guide 203 has two openings 203*a* and 203*b* formed at the end on the back side, and the cleaning unit 205 has two projections 205*c* and 205*d*. The cleaning unit 205 is fixed by inserting the projections 205*c* and 205*d* of the cleaning unit 205 into the openings 203*a* and 203*b*, and thrusting them to the attached members of the lower conveyance guide 203, which are not illustrated.

By taking the aforementioned configuration, the cleaning unit 205 can be easily detached, and even when the cleaning unit 205 is consumable, time and cost for exchange is low. Accordingly, entire cost including running cost can be reduced.

Since the cleaning unit 205 can be attached and detached while the conveyance unit 200 (the lower conveyance guide 203) is drawn out, an operation is easy, and a time taken for attaching and detaching the cleaning unit 205 can shorten, and a down time can be saved.

In the first exemplary embodiment, the cleaning unit 205 has the elastic member 205*b* as a pushing member. The second exemplary embodiment will be described below, and a cleaning unit has a spring member as a pushing member in the second exemplary embodiment.

Figure 9:
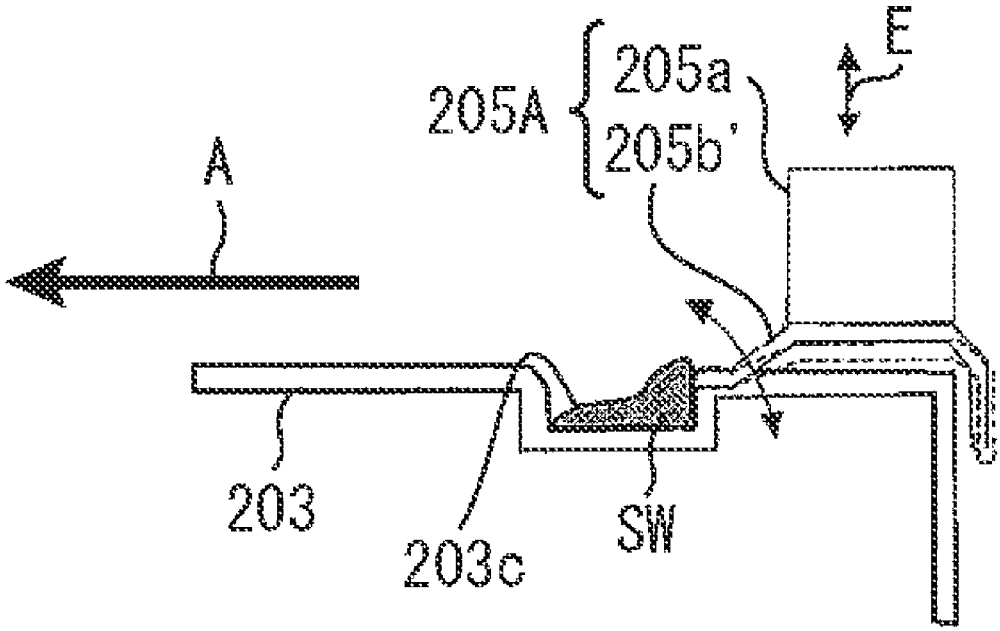
FIG. 9 illustrates a configuration of a cleaning unit in a secondary exemplary embodiment of the present invention.

FIG. 9 illustrates a configuration of a cleaning unit 205A in the second exemplary embodiment. The cleaning unit 205A of the second exemplary embodiment has a cleaning member 205*a* similar to the cleaning member in the first exemplary embodiment. The cleaning unit 205A has a metallic plate spring 205*b*' as a pushing member. The cleaning member 205*a* is fixed on the plate spring 205*b*' with an adhesive. By using the plate spring 205*b*' as the pushing member, the pushing member can have high durability, and damaging and plastically deforming can be reduced.

In addition, in FIG. 9, a concave portion 203*c* for collecting paper dusts is provided around the front side of the cleaning unit 205A (the front side in the cleaning direction illustrated with the arrow A). The concave portion 203*c* is formed outside the paper passing area of the lower conveyance guide 203. When the conveyance unit 200 (illustrated in FIG. 1) is drawn out, the cleaning unit 205A wipes paper dusts SW adhering to the guide surface of the upper conveyance guide 202 (illustrated in FIG. 3) which has the sheet control members 204 and 204A, and the paper dusts SW are collected in the concave portion 203*c*. By forming the concave portion 203*c*, the wiped paper dusts SW can be prevented from overflowing to the paper passing area of the lower conveyance guide 203.

The first and second exemplary embodiments were described, but the present invention is not restricted in the first and second exemplary embodiments.

The aforementioned exemplary embodiments use an electro-photographic image forming apparatus as an example, in which the image forming unit forms a toner image as an image on a sheet, and the fixing unit fixes the toner image. However, the present invention is not restricted to this method. The present invention can be applied to image forming apparatuses such as those using an ink-jet method or offset printing method.

In the aforementioned exemplary embodiments, a number of the sheet control members 204 and 204A is two. However, the number of a sheet control member is not restricted to two, but can be one or three or more. In addition, the present invention can be applied to an upper conveyance guide having no sheet control member.

In the aforementioned exemplary embodiments, the upper conveyance guide 202 is fixed to the printer main body 110, and the lower conveyance guide 203 is drawn out. However, the lower conveyance guide can be fixed to the printer main body, and the upper conveyance guide can be drawn out. In this case, the cleaning unit is provided at the upper conveyance guide.

In the aforementioned exemplary embodiments, the present invention is applied to a pair of the conveyance guides 202 and 203 between the skew correction mechanism 148 and the image forming unit 100. However, the present invention is not restricted to the pair, and can be applied to any other pair of conveyance guides.

Further, the cleaning member may be any material such as a brush or nonwoven fabric if the member can clean the guide surface.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-020827 filed Jan. 30, 2009, which is hereby incorporated by reference herein in its entirety.

What is claimed is:

1. A sheet conveying apparatus configured to convey a sheet along a sheet conveyance path provided in an apparatus main body, the sheet conveying apparatus comprising:

a first conveyance guide having a first guide surface for guiding a sheet;

a second conveyance guide having a second guide surface arranged facing the first guide surface of the first conveyance guide, which serves as the sheet conveyance path together with the first conveyance guide, and is drawable in a direction intersecting a sheet conveyance direction with respect to the apparatus main body; and a cleaning unit provided on a back side in a drawing-out direction of the second conveyance guide, and configured to clean the first guide surface of the first conveyance guide while moving together with the second conveyance guide when the second conveyance guide is drawn out from the apparatus main body, wherein the cleaning unit comprises a cleaning member which is in contact with the first guide surface of the first conveyance guide, a pushing member, which is an elastic member made of a foamable material, for pushing the cleaning member toward the first guide surface, and a flexible member provided facing a side surface on the back side of the elastic member in the drawing-out direction of the second conveyance guide to protect the elastic member.

2. The sheet conveying apparatus according to claim 1, wherein the cleaning member is formed by bundling a wire-shaped member made of a synthetic resin, which is elastic and deformable.

3. The sheet conveying apparatus according to claim 1, wherein the cleaning unit is provided detachably at the second conveyance guide.

4. A sheet conveying apparatus configured to convey a sheet along a sheet conveyance path provided in an apparatus main body, the sheet conveying apparatus comprising:

a first conveyance guide having a first guide surface for guiding a sheet;

a second conveyance guide having a second guide surface arranged facing the first guide surface of the first conveyance guide, which serves as the sheet conveyance path together with the first conveyance guide, and is drawable in a direction intersecting a sheet conveyance direction with respect to the apparatus main body; and a cleaning unit provided on a back side in a drawing-out direction of the second conveyance guide, and configured to clean a first guide surface of the first conveyance guide while moving together with the second conveyance guide when the second conveyance guide is drawn out from the apparatus main body, wherein the cleaning unit comprises a cleaning member which is in contact with the first guide surface of the first conveyance guide, and a spring member which pushes the cleaning member toward the first guide surface.

5. A sheet conveying apparatus configured to convey a sheet along a sheet conveyance path provided in an apparatus main body, the sheet conveying apparatus comprising:

a first conveyance guide having a first guide surface for guiding a sheet, the first conveyance guide comprises a guiding base body and a flexible sheet control member, provided at the guiding base body, configured to contact a sheet surface and to control an orientation of the sheet;

a second conveyance guide having a second guide surface arranged facing the first guide surface of the first conveyance guide, which serves as the sheet conveyance path together with the first conveyance guide, and is drawable in a direction intersecting a sheet conveyance direction with respect to the apparatus main body; and a cleaning unit provided on a back side in a drawing-out direction of the second conveyance guide, and configured to clean a first guide surface of the first conveyance guide while moving together with the second conveyance guide when the second conveyance guide is drawn out from the apparatus main body, wherein both ends of the flexible sheet control member in the direction intersecting the sheet conveyance direction are inclined with respect to the sheet conveyance direction, wherein the cleaning unit comprises a cleaning member which is in contact with the first guide surface of the first conveyance guide, and a pushing member for pushing the cleaning member toward the first guide surface, the cleaning unit cleans the flexible sheet control member.

6. An image forming apparatus comprising a sheet conveying apparatus configured to convey a sheet along a sheet conveyance path provided in an apparatus main body, the image forming apparatus comprising:

a first conveyance guide having a first guide surface for guiding a sheet;

a second conveyance guide having a second guide surface arranged facing the first guide surface of the first conveyance guide, which serves as the sheet conveyance path together with the first conveyance guide, and is drawable in a direction intersecting the sheet conveyance direction with respect to the apparatus main body; and a cleaning unit provided on a back side in a drawing-out direction of the second conveyance guide, and configured to clean the first guide surface of the first conveyance guide while moving together with the second conveyance guide when drawing out the second conveyance guide from the apparatus main body, wherein the cleaning unit comprises a cleaning member which is in contact with the first guide surface of the first conveyance guide, a pushing member, which is an elastic member made of a foamable material, for pushing the cleaning member toward the first guide surface, and a flexible member provided facing a side surface on the back side of the elastic member in the drawing-out direction of the second conveyance guide to protect the elastic member.

7. The image forming apparatus according to claim 6, wherein the cleaning member is formed by bundling a wire-shaped member made of a synthetic resin which is elastic and deformable.

8. The image forming apparatus according to claim 6, wherein the pushing member is an elastic member made of a foamable material.

9. The image forming apparatus according to claim 6, wherein the cleaning unit is provided detachably at the second conveyance guide.

10. An image forming apparatus configured to convey a sheet along a sheet conveyance path provided in an apparatus main body, the image forming apparatus comprising:

a first conveyance guide having a first guide surface for guiding a sheet;

a second conveyance guide having a second guide surface arranged facing the first guide surface of the first conveyance guide, which serves as the sheet conveyance path together with the first conveyance guide, and is drawable in a direction intersecting a sheet conveyance direction with respect to the apparatus main body; and a cleaning unit provided on a back side in a drawing-out direction of the second conveyance guide, and configured to clean a first guide surface of the first conveyance guide while moving together with the second conveyance guide when the second conveyance guide is drawn out from the apparatus main body, wherein the cleaning unit comprises a cleaning member which is in contact with the first guide surface of the first conveyance guide, and a spring member which pushes the cleaning member toward the first guide surface.

11. An image forming apparatus configured to convey a sheet along a sheet conveyance path provided in an apparatus main body, the image forming apparatus comprising:

a first conveyance guide having a first guide surface for guiding a sheet, the first conveyance guide comprises a guiding base body and a flexible sheet control member, provided at the guiding base body, configured to contact a sheet surface and to control an orientation of the sheet;

a second conveyance guide having a second guide surface arranged facing the first guide surface of the first conveyance guide, which serves as the sheet conveyance path together with the first conveyance guide, and is drawable in a direction intersecting a sheet conveyance direction with respect to the apparatus main body; and a cleaning unit provided on a back side in a drawing-out direction of the second conveyance guide, and configured to clean a first guide surface of the first conveyance guide while moving together with the second conveyance guide when the second conveyance guide is drawn out from the apparatus main body, wherein both ends of the flexible sheet control member in the direction intersecting the sheet conveyance direction are inclined with respect to the sheet conveyance direction, wherein the cleaning unit comprises a cleaning member which is in contact with the first guide surface of the first conveyance guide, and a pushing member for pushing the cleaning member toward the first guide surface, the cleaning unit cleans the flexible sheet control member.

* * * * *